US005971225A

United States Patent [19]

Kapsa

[11] Patent Number: 5,971,225

[45] Date of Patent: Oct. 26, 1999

[54] ADHESIVE DISPENSER WITH REAR FILLING STRUCTURE

[75] Inventor: Hans-Martin Kapsa, Ottersweier, Germany

[73] Assignee: UHU GmbH, Baden, Germany

[21] Appl. No.: 08/852,506

[22] Filed: May 7, 1997

[30] Foreign Application Priority Data

May 8, 1996 [DE] Germany ..... 196 18 521

[51] Int. Cl.[6] ..... B65D 35/44

[52] U.S. Cl. ..... 222/212; 222/482; 222/546; 215/2; 215/311; 215/355

[58] Field of Search ..... 215/2, 307, 311, 215/355; 222/212, 481.5, 482, 386, 387, 327, 546

[56] References Cited

U.S. PATENT DOCUMENTS

| | | | |
|---|---|---|---|
| 52,379 | 2/1866 | Bennett | 215/307 |
| 359,003 | 3/1887 | Baldwin | 222/482 X |
| 983,423 | 2/1911 | Brelle | 215/307 |
| 1,761,164 | 6/1930 | Wilson | 222/482 |
| 2,214,346 | 9/1940 | Pim | 215/307 X |
| 2,876,935 | 3/1959 | Lindberg | 222/482 X |
| 4,260,065 | 4/1981 | Van Cromvoirt | 215/2 |
| 4,819,836 | 4/1989 | Meckenstock | 222/386 |
| 5,178,305 | 1/1993 | Keller | 222/386 |
| 5,337,924 | 8/1994 | Dickie | 222/212 |
| 5,377,880 | 1/1995 | Montenieri et al. | 222/546 |
| 5,624,057 | 4/1997 | Lifshey | 222/212 |
| 5,649,648 | 7/1997 | Lier et al. | 222/212 X |

FOREIGN PATENT DOCUMENTS

| | | | |
|---|---|---|---|
| 1303150 | 7/1962 | France . | |
| 8404703 | of 1984 | Germany | B43M 11/06 |
| 8404703 | 5/1984 | Germany . | |
| 3635849 | of 1988 | Germany | B65D 83/00 |
| 36 35 849 A1 | 4/1988 | Germany . | |
| 41 04 871 C 2 | 8/1992 | Germany . | |
| PCT/GB89/01293 | 5/1990 | WIPO . | |
| PCT/FR92/01064 | 5/1993 | WIPO . | |

*Primary Examiner*—Kenneth Bomberg
*Attorney, Agent, or Firm*—Graham & James LLP

[57] ABSTRACT

A new method fills a dispenser with cyanoacrylate adhesive from the rear. The container is sealed by a pressed-in base section (4). The latter has a vent opening which can be sealed, preferably by a plug (68) pre-mounted on it. Preferably the contacting surfaces of the container and this base have an oval shape. In this novel method, the container is first filled, while the end is still open. The base is then pressed in, sealing it onto the container. In so doing, the air displaced, is released through the base vent. During the final phase of pressing-in, the vent is plugged, irreversibly sealing it. Also claimed is an adhesive dispenser, essentially as described, with further preferred detail of the seals, the pipette construction of the container and a slot valve in the plug unit. USE—A dispenser filling method and dispenser, especially suitable e.g. for a super glue. ADVANTAGE—This method allows the container to be filled without the base in place, hence avoiding filling through a very fine hole or nozzle. The latter course would involve a danger of air entrainment and/or foaming. Air per se has no harmful effect, but its water vapor content causes undesirable polymerization of cyanoacrylate adhesives. The method makes a leakproof and secure fastening at the base, avoiding welding or adhesion. A simple, low cost mechanical stage is all that is required. Further manufacturing advantages of the base and plug are detailed in the text.

3 Claims, 2 Drawing Sheets

ADHESIVE DISPENSER WITH REAR FILLING STRUCTURE

FIELD OF THE INVENTION

Figure 1A:
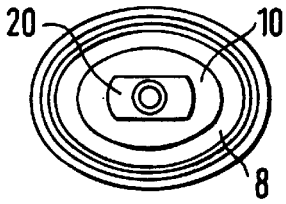

The invention relates to a method of filling an adhesive dispenser, in particular for cyanoacrylate from the rear.

BACKGROUND OF THE INVENTION

German patent DE-C2-41 04 871, ('871) relates to an applicator for a liquid application medium. A suitable liquid application medium, in the case of the known applicator, is a liquid which is intended for writing, drawing, painting or marking, but not a liquid adhesive. In the case of the known applicator, a relatively small opening in the base part is used for filling and, if appropriate, refilling, from the rear. After the filling or refilling operation, this relatively small opening is sealed by a releasable closure, which may be connected integrally to the base part, as a closure flap for example, via a film hinge. The shank-like receiving body for the liquid and the closure of the opening in the base part should be, in particular, of an oval or elongate cross-sectional shape. If the receiving container and its base part are not formed integrally but rather comprise two parts, in the case of which the base part, in particular, is pushed into the receiving container by means of a body forming a hollow profile, a permanent, non-releasable connection should be produced, for example, by welding, adhesive bonding or crimping. This type of connection requires a separate operation for the fastening step in each case.

There are certain adhesives, such as, in particular, so-called quick-action adhesives, which, in the raw state, are more fluid than water, that is to say have a lower viscosity than water. Cyanoacrylate belongs to this group of adhesives. This particular quick-action adhesive is inert with respect to the gases in the air, but polymerizes under the influence of water, including air moisture. In the event of filling an adhesive dispenser having the device features of the German patent '871, the highly fluid character of the relevant quick-action adhesive would not actually present any difficulties as far as filling the receiving container through the relatively small opening is concerned. However, difficulties may arise from the fact that the highly fluid filling jet carries along air moisture and, reacting with the air moisture, undergoes prepolymerization during the filling operation, it being possible for said prepolymerization to manifest itself by the formation of foam.

German patent DE-U1-84 07 703.8 has already disclosed an adhesive dispenser, in particular for cyanoacrylate, which has a receiving container, of which the cross section may be approximately oval and which is filled with the adhesive through its initially still free end-side opening. After the filling operation, the end-side opening of the receiving container is closed by a base part which projects into the receiving container by means of an open hollow cylinder and, in the base plane, has an annular flange which is designed with a larger diameter than the open hollow cylinder and comes to rest against the end surface of the receiving container. This means that, if a further-processing step were dispensed with, the base part can be drawn axially out of the receiving container again without any difficulty. Practical embodiments of this adhesive dispenser which are available on the market undergo, as a further processing step, ultrasonic welding for the purpose of connecting and sealing the receiving container and base part irreversibly with respect to one another. In order for this ultrasonic welding to be effective and for enclosed air to escape as the base part is pushed into the container, before it reaches the end stop, it is necessary here for a free air gap to remain between the inner wall surface of the receiving container and the hollow cylinder of the base part engaging in the receiving container. It has been shown that with this method of assembly, within the context of the tolerances, on the one hand, of the dimensions of the receiving container and base part and, on the other hand, of the filling, there is still residual air which remains in the filled and closed receiving container, or at least pressure being exerted on the filling composition by walls pressing thereon, and these situations result in an undesirable initial discharge of the adhesive when the adhesive dispenser is used for the first time. However, this is extremely undesirable precisely in the case of quick-action adhesives, which are intended to be applied as thinly and sparingly as possible in order for the definitive polymerization to be rapid and uniform. The known method of assembly also includes the risk, which may occur precisely in the case of welding defects, of it being possible, despite the ultrasonic welding, for a user, e.g. even a child, to lever off the base part from the receiving container using a relatively low amount of force, as a result of which the entire contents of the receiving container can then flow out suddenly. This then not only means that the adhesive dispenser is rendered completely useless and that its contents are destroyed, but also may be extremely harmful, or indeed hazardous, to objects and individuals.

SUMMARY OF THE INVENTION

The object of the invention is to be able to fill an adhesive dispenser without the above-mentioned risks of foam being formed by an undesirable prepolymerization action in the presence of air moisture, and without there being any need, once the receiving container and base part have been connected definitively, for a further-processing step such as ultrasonic welding or the like. The method of assembly should be selected such that, as a development of the invention, it is also possible to enhance the way in which the base part is secured against undesirable separation from the receiving part.

The invention is based on the finding that a liquid dispenser of the known design, such as is described in the German patent '871, can be rendered usable for this purpose with a completely different filling method.

Unlike the known filling method disclosed by said patent the inventive method, in accordance with the method steps of the present invention provides for the receiving container to be filled through the as yet available large, free end-side cross section before the base part is pushed into the receiving container. When the base part, serving as base cover, is pushed into the receiving part, the relatively small opening in the base part, said opening serving as a filling opening in the previously known case, is then used as an air-extraction opening for air which is displaced in the receiving container during the push-in movement. Together with its closure, the opening in the base part thus serves, according to the invention, as an air-extracting valve which is sealed irreversibly after the filling operation. In contrast to the known case, the invention does not provide for a refilling operation being carried out through this opening.

The irreversible latching of the receiving container and base part dispenses with separate welding, adhesive-bonding or crimping operations and, if a plug-in closure is provided, as is already the case with the previously known applicator, cuts down the final assembly of the adhesive dispenser to plug-in operations both for connecting the receiving container to the base part and for closing the opening of said base part by way of the closure.

The necessary sealing of the receiving container with respect to the base part can be carried out in many ways, for example by designing the latching device simultaneously as a sealing device or by the base-part body which projects into the receiving container being overdimensioned in a positively locking manner similarly to a cork closure. Preferred developments are described below.

In principle, it is possible for the air-extracting valve on the base part to be closed by way of the closure at the same moment, or in the same operating phase, in which the base part is latched in on the receiving container. However, it is preferred from a technical point of view for the operation of closing the air-extraction opening to be delayed somewhat with respect to the latching-in operation, experience showing that this does not have any serious effect on the filling of the receiving container.

It is already known per se to fill a completely prefabricated tube, at it removal mouthpiece, with pastes, ointments or cremes by means of a tube-filling device and, in so doing, to allow air which is displaced from the tube body to escape through an opening in the lateral surface of the tube body, this opening being closed permanently once the tube has been filled. However, unlike the invention, this has nothing to do with filling a receiving container which is still open on the end side and is closed by a base part, which is pushed in the manner of a plunger and on which the air-extraction valve is formed, only once the end-side filling operation has taken place.

It is also otherwise known in many cases to provide fluid-substance dispensers with valve devices which allow air to pass through them, although these devices are provided in each case for other purposes, for example to make it possible for a tube body which has had pressure exerted on it to resume its original shape thereafter without retaining a vacuum (e.g. known from U.S. Pat. No. 2,777,612, reference numeral 16). It is also already known for the base of a cartridge-like receiving container for adhesive to be provided with an opening which is only opened when the cartridge starts to apply adhesive, thus permitting adhesive to flow out at the mouthpiece of the receiving container (DE-A1-39 37 298, reference 19).

The invention can be implemented particularly easily if the adhesive dispenser is filled in a position in which its rear is at the top, with the result that the receiving container then has the character of an upright vessel which is open at the top and whose subsequent removal opening, accordingly, is arranged at the bottom and remains closed during the filling operation. After the filling operation, the base part is then pushed into the hitherto open end-side, top end of the receiving container, through the filling opening, in a cork-like manner and the displaced air is discharged through the opening in the cork-like base part. In the end position, this opening is then sealed irreversibly by the closure. If, as is also the case with the previously known applicator, the base part and its closure are pre-assembled, there is no need for any separate part, which would then need to be kept in stock separately, for the purpose of closing the air-extraction valve in the base part.

Likewise, once the receiving container is finally "corked" by the base part, there is no need for any further, separate processing operation for the purpose of fastening these two parts definitively to one another if, in accordance with the invention, the base part is simply latched in on the receiving container at the end of the push-in movement. In this case, it is possible, in principle, for active latch-in means to be arranged both on the receiving container and on the base part. This option additionally includes the possibility, which is already provided in the case of the known applicator, of the base part projecting into the receiving container by means of a plunger-like body designed as a hollow profile. The developments in the design of the latching devise according to an embodiment of the invention relate specifically to this supplementary feature. In accordance therewith, a groove/tongue engagement means is provided for the latching-in operation, this engagement means having a particularly good snap action. Such a design of the latching device is also possible if the plunger-like body of the base part is, for example, of solid design rather than being a hollow profile. However, the hollow-profile design is preferred for the reason of reducing the mass of the dispenser.

German patent DE-A1-36 35 849 discloses a dispenser for discharging pasty compositions which can be forced out of the dispenser housing, by a plunger, in a stepwise manner by the actuation of a pushbutton in each case. Such a plunger actuation is not considered, and indeed not even desired, in the case of the adhesive dispenser according to the invention; rather, the minimal quantities of quick-action adhesive which are required are removed from the receiving container in an accurately metered manner by way of sensitively applied manual pressure on the outer wall of said container. The known dispenser for pasty compositions is filled through the end-side opening of the dispenser housing before the plunger is pushed into the dispenser housing to rest against the pasty composition which has been introduced. Escaping air is discharged, in the process, through a central opening in the plunger, it being possible for said opening to be closed at a later stage by a stopper. Unlike the base part of the adhesive dispenser according to the invention, the plunger is then also used, as has been mentioned, for the removal of the pasty composition, via a stepping mechanism, whereas, in total contrast to this and with a minimal degree of structural outlay in comparison, the base part of the adhesive dispenser according to the invention is latched irreversibly.

In the embodiments of the present invention there are various operating steps for preferred preparation for filling the adhesive dispenser from the rear, thus making it possible, virtually without having to keep any dispenser elements in stock, for the entire filling operation to take place after only a minimal number of operating steps. In this case, it is also aimed, in particular, to reduce injection-mold costs and, in general, to reduce costs as regards sorting and finishing systems. The plug-in connections used provide for vacuum-tight packing of the adhesive in the adhesive dispenser and, together with development measures described below, also ensure that the expressly desired disposable pack can be opened without auxiliary means and thus avoids, as far as possible, damage to other objects or individuals by the undesirable discharge of adhesive.

Irrespective of whether the action of latching the base part in the receiving container itself provides a sealing function for the finished adhesive dispenser or not, said sealing function not being provided, in some circumstances is preferred. This not only ensures reliable final sealing, but also effects sealing during the movement of the base part being pushed into the receiving container, and thus ensures reliable air displacement through the air-extraction valve without excessive pushing-in pressure being required, as would be the case if the entire base-part body which is to be pushed into the receiving container were overdimensioned.

It has already been mentioned that the adhesive dispenser according to the invention should, as a disposable container, be rendered as resistant to manipulation as possible. It has been shown that, in some circumstances, incorrect manipulation can force apart the positively locking gap between the receiving container, on the one hand, and, on the other hand, the base-part body which has been pushed into said receiving container. It is, indeed, possible to counter this risk by way of a suitable cross-sectional shape of the adhesive dispenser, or of the receiving container and of the base-part body engaging therein, in which case, rather than selecting, for instance, a rectangular or even flattened cross section, a radial cross section ranging from oval to cylindrical is selected in preference. However, even then, there is still some risk of incorrect manipulation causing the adhesive dispenser to burst open. This risk is countered by a measure using a special retaining device to prevent the clearance between the base part and the receiving container from being opened up.

It is also possible for the retaining device to assume additional sealing functions in the variously provided engagement regions.

Other preferred configurations of the adhesive dispenser in the region of the receiving container are provided which coordinate the receiving function and the filling function with one another in optimum fashion.

In another embodiment the base-part hollow body, already provided in the case of the main applicator, which is pushed into the receiving container, to the effect that said hollow body of the base part is closed at the end. It is particularly preferred, for the application according to the invention, to embody the dispenser as a pipette, be this oval or cylindrical, which combines said two viewpoints with one another in optimum fashion. The adhesive dispenser according to the invention is typically designed as a pipette with a capacity of 10 ml or as a 10-g pipette.

Preferred embodiments of the air-extraction valve, on the base part include where said valve may be entirely concealed in an end-side concave recess of the base part without, as is the case with the applicator of German patent '871 of the same generic type, forming, with the closure itself, the end-side standing surface of the applicator.

The invention is explained in more detail hereinbelow by way of an exemplary embodiment and with reference to schematic drawings, in which:

SHORT DESCRIPTION OF THE DRAWINGS

Figure 1:
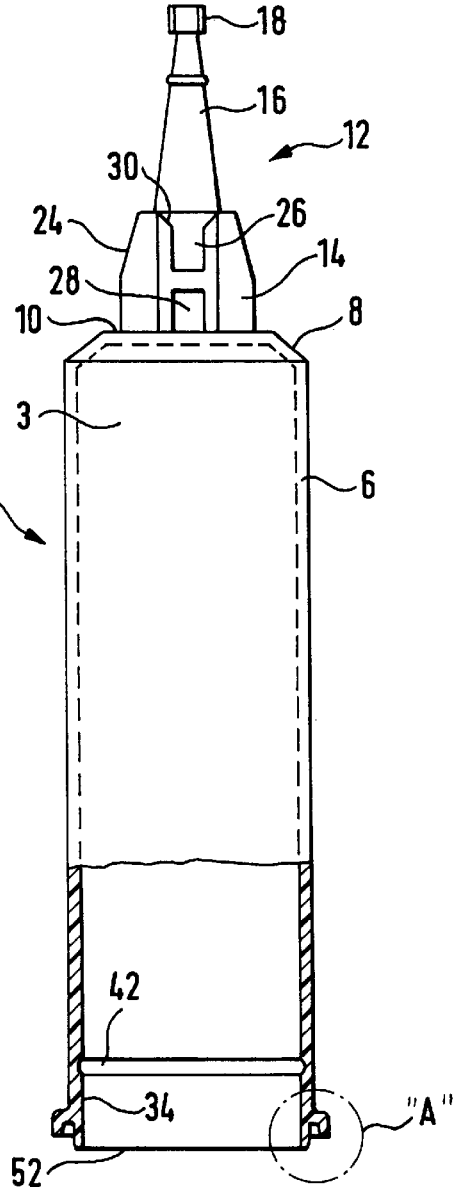
Figure 1C:
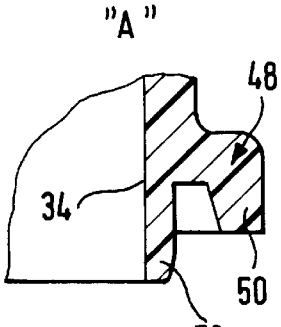
Figure 1B:
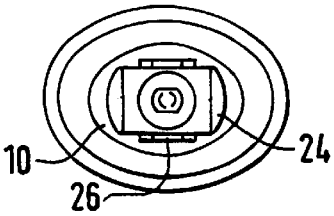
Figure 2:
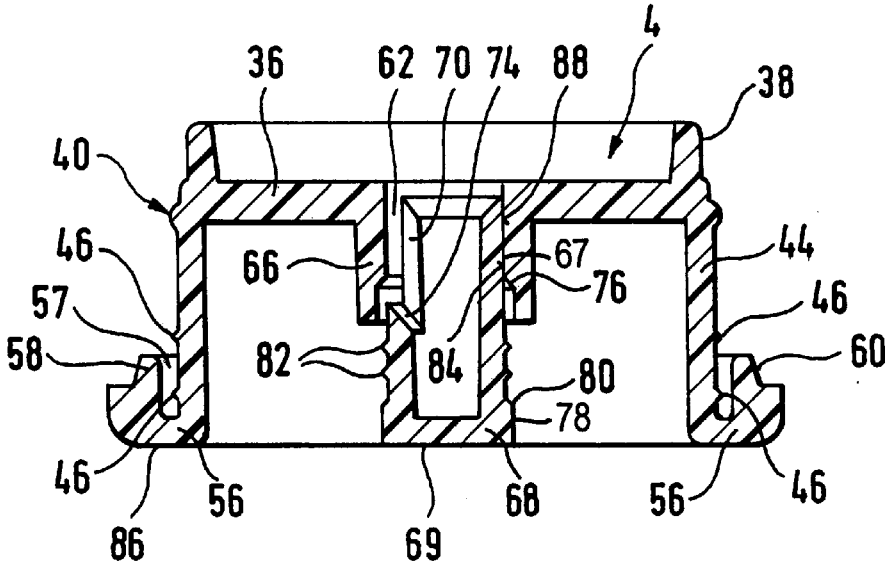
Figure 2A:
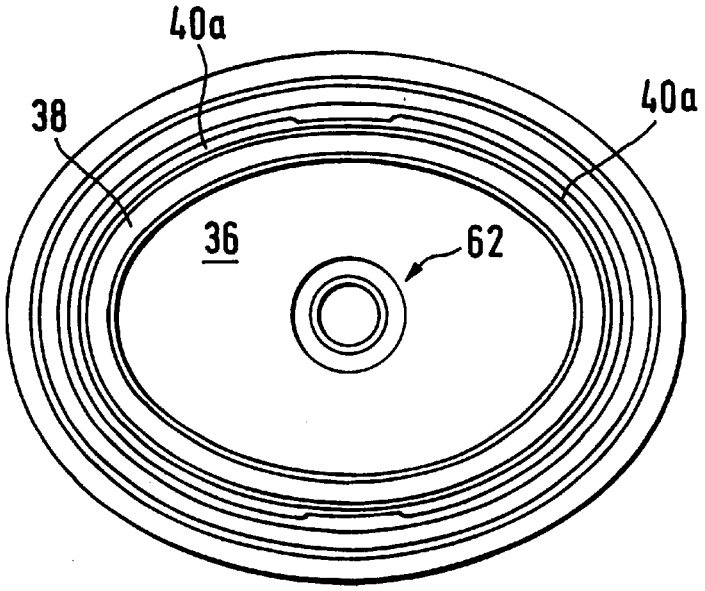

FIG. 1 shows a side view, which is partially in section in the longitudinal direction, of the main body of an inventive adhesive dispenser without the base part pushed in;

FIGS. 1*a* and 1*b* each show a view of the main body according to FIG. 1 from the removal side (FIG. 1*a* as a plan view of FIG. 1) and from the opposite end side used for filling purposes (FIG. 1*b* as a view of FIG. 1 from the bottom), FIGS. 1*a* and 1*b* each being on a somewhat reduced scale in comparison with FIG. 1;

FIG. 1*c* shows the detail A in FIG. 1 on an enlarged scale;

FIG. 2 shows a longitudinal section of the base part, which can be pushed into the open end of the main body according to FIG. 1; and FIG. 2*a* shows a plan view of the base part according to FIG. 2.

A pipette-like adhesive container is made up of two components which consist of a thermoplastic material which is inert in relation to the adhesive, these two components being the receiving container 2 according to FIG. 1 and the base part 4 according to FIG. 2.

DETAILED DESCRIPTION OF THE INVENTION, THE DRAWINGS AND THE PREFERRED EMBODIMENTS

The receiving container 2 encloses the receiving chamber 3 of the adhesive with an oval sleeve 6 which, with the exception of the special features described hereinbelow, is of constant cross section along its axis depicted by chain-dotted lines. one end, the top end in FIG. 1, the sleeve merges, via a sloping shoulder 8 which is also of oval cross section and tapers at 45° in axial continuation of the sleeve 6, into an end-side termination wall 10 which is configured as an oval at right angles to the axis of the pipette.

A non-oval mouthpiece 12 continues from said termination wall 10 in the axial direction of the pipette. This mouthpiece continues from the termination wall 10 along the axis of the pipette, by means of a neck piece 14 which is of elongate rectangular shape and is mirror-symmetrical with respect to said pipette axis, and merges into a removal nipple 16 which tapers towards the tip, is of circular cross section and whose tip, which serves for the subsequent removal of adhesive, is closed, prior to the removal operation, by a closure 18, for example in the configuration of a cylindrical screw-off nipple with predetermined breaking point.

It can be seen from FIG. 1*a* that the receiving chamber 3, which is initially in the form of an oval column, continues, in the mouthpiece 12, into an approximately rectangular adjoining chamber 20 which then merges, in the direction of the removal tip, into the circular-cone-shaped inner chamber 22 of the removal nipple 16.

The surface configuration of the mouthpiece 12 is selected such that a plug-on closure (not illustrated) can be plugged on tightly, before and after use of the dispenser, in order to protect the mouthpiece 12. As a centering aid when the plug-on closure is plugged on, the neck piece 14 has a run-on slope 24 on the outside of each of the two short sides of the rectangular cross section. Formed on each of the two long sides of the rectangular neck piece 14 is a risen H-profile which extends along the axis of the pipette and, in the orientation of FIG. 1, forms a top depression 26 and a bottom depression 28 in each case between the two parallel ribs of the H-profile. The top depression 26 is provided with a run-on slope 30 at its axially outer free end and interacts with the outer run-on slope 24 of the neck piece 14 upon alignment of the plug-on closure when the latter is plugged on to the mouthpiece 12. When the plug-on closure has been plugged on to the full extent, it can then latch, by means of a corresponding catch, into the bottom depression 28, which serves as a latching hollow in each case, circumferential sealing of the mouthpiece 12 with respect to the plug-on closure taking place via a sealing bead 32 which encircles the removal nipple 16.

At its free end remote from the mouthpiece 12, the entire end-side sleeve cross section 52 is free such that, after the receiving chamber 3 has been filled with adhesive, the base part 4 can be pushed in along the inner wall 34 of the sleeve 6, said inner wall serving as a guide for the base part 4, and can then be mounted there in a sealed and captive manner in the end position of the push-in movement.

For this purpose, the overall configuration of the base part 4 is also selected to be of essentially complimentary oval shape in the outer regions in any case.

The base part 4 according to FIG. 2 is thus formed by a hollow profile which has an oval outer sleeve which is stepped on the outside in the axial direction and, in the region of its stepped formation, is closed by the base 36 of the adhesive container in the manner of a transverse partition. The end 38 of the sleeve of the base part 4, said end being at the top in FIG. 2, is set back somewhat, as push-in guide, with respect to the inner surface 34 of the sleeve 6 in order that, after the receiving chamber 3 has been filled, tolerance-compensating insertion of the base part 4 in the sleeve 6 is facilitated. In the final mounting position of the base part 4 in the sleeve 6, an outer annular bead 40 on the circumference of the hollow profile, said annular bead being at the axial level approximately of the base 36 or of the outer surface thereof, snaps into a latching groove 42 in the inner wall surface 34 of the sleeve 6 and fixes the end position of the base part 4 in the receiving container 2 in a definitive and captive manner. In order to facilitate the action of the annular bead 40 snapping into the latching groove 42, the annular bead 40 is subdivided, according to FIG. 2*a*, into two resilient bead sections 40*a*, which are spaced apart from one another in the center of the two elongate sides of the oval cross section and extend around the narrow cross section sides of the oval in a mirror-symmetrical manner with respect to the axis. The bead sections 40*a* are thus arranged as circumferential segments on the outside of the hollow profile of the base part 4.

As far as tolerances are concerned, the end 44 of the base part 4, said end being axially on the outside or on the bottom in FIG. 2, is matched as closely as possible to the inner wall surface 34 of the sleeve 6 and, outside of the base 36, is provided externally with two encircling sealing beads 46 which are offset axially with respect to one another and interact in a sealing manner with the inner wall surface 34 of the sleeve 6. It is important for the sea ling engagement of the sealing beads 46 on the inner wall surface 34 of the sleeve 6 to be permanently maintained even in the event of deformation forces being applied to the outside. For this purpose, use is made of a retaining device, which is described hereinbelow with reference to FIGS. 1 and 1*c*, on the one hand, and FIG. 2, on the other hand.

First of all, not far from the free end of the sleeve 6, but set back axially to some extent with respect to said free end, the receiving container 2 is provided with an end-side annular extension in the form of an encircling outer flange 48 which has an annular end-side protrusion 50 which nevertheless, rather than projecting into the plane of the open cross section 52 of the sleeve 6, is set back with respect to said plane approximately by the thickness of one wall. As a result, the free end of the sleeve 6 still projects in front of the end-side protrusion 50 to some extent.

Secondly, the base part 4 also has an encircling outer flange 56 at the free end of its bottom outer end 44, said flange forming an encircling rearwardly directed protrusion 58, which is designed with an outwardly encircling step 60, at a distance from the outer surface of the end 44, an encircling slit 57 thus being formed between the outer flange 56 and said outer surface.

It can be seen from FIG. 2 that one sealing bead 46 is formed midway along the axial extent of the encircling slit 57, whereas the other sealing bead in FIG. 2 is arranged at a higher level and thus further towards the inside, outside the rearwardly directed protrusion 58.

For the assembly of the adhesive dispenser, the end 44 of the hollow profile of the base part 4 is guided in a plunger-like manner within the inner surface 34 at the free end of the sleeve 6. In the definitive assembly position, in which the annular bead 40 has been latched into the annular groove 42 by means of its circumferential segment 40*a*, the free end 52 of the sleeve 6 engages in the slit and is thereby retained, on the inside, by the end 44 and, on the outside, by the rearwardly directed protrusion 58, which, in turn, is additionally retained in that the end-side protrusion 50 on the outer flange 48 of the sleeve 6 engages in the encircling step 60 of the rearwardly directed protrusion 58.

As far as the method of the invention is concerned, first of all the receiving chamber 3 of the receiving container 2 is filled with adhesive through the plunger-free inner cross section of the sleeve 6, before the plunger-like base part is then introduced, by means of its end 38, into the sleeve 6 of the receiving container 2 and is pushed axially into said container in a plunger-like manner, the base 36 serving as the plunger surface. In order to be able to displace enclosed air until such time as the definitive latching-in position is reached, the base 36 is provided with an air-extraction valve 62 which, once the base part 4 has been latched into the receiving container 2, is also closed by the assembly means.

In order to form the air-extraction valve 62, the base 36 of the base part 4 has a central circular opening 64 which is lengthened axially by a cylinder piece 66 which projects outward from the base 36 in a sleeve-like manner and is provided at its free end with an encircling indent 67 on the inside. Said cylinder piece 66 forms a push-in guide for a stub-like closure 68, which can be displaced axially in the cylinder piece, serving as push-in guide, or in the outwardly projecting sleeve 66. The closure 68 is in the form of a hollow cylinder which is open on the inside, is closed on its outer end side 69 and is provided on one flank with a longitudinal slot 70 which is open towards the inner, free end of the hollow cylinder. Said longitudinal slot terminates, on the inside, in a slope which runs radially outward towards the inside. Together with the conically bevelled bottom 76 of the indent 67, through which it is possible for air to pass between the sleeve 66 and the closure 68, the outer edge of said slope controls the commencing closure position of the air-extraction valve 62.

At its free end, the stub-like closure 68 has a thickened head 78 around its end side, this head having, towards the inside, a transition slope 80 which runs into the normal outer cross section of the stub-like closure 68. Once the stub-like closure 68 has been pushed into the full extent, said transition slope 80 comes to rest against the bevelled bottom 76 of the indent 67. This closure 68 is sealed with respect to the base part 4 by a plurality of, in this case two, sealing beads 82 which encircle the outer circumference of the stub-like closure 68 and, when the closure is in the pushed-in end position, come into sealing engagement with the non-indented inner surface 84 of the sleeve 66. In this end position, the head 78 is largely, or wholly, concealed in the indent such that there is virtually no question of renewed opening of the air-extraction valve as the result of the stub being manipulated out. If desired, this definitive closure position may also be additionally secured by latching means (not shown) which act between the closure 68 and the sleeve 66.

The closure 68, which is designed as a hollow profile as described, can thus be axially displaced, as a stub, in the cylinder piece or the sleeve 66 such that, in the case of axially outer positions, air can escape from the receiving chamber 3 to the outside through the longitudinal slot 70 of the closure 68, whereas, when the stub has been pushed into the push-in guide of the cylinder piece or of the sleeve 66, the longitudinal slot is sealed. FIG. 2 shows the pre-mounted position of the closure 68 in the sleeve 66, in which the cylinder piece or the sleeve 66 and the projecting part of the pre-mounted stub-like closure 68 are arranged in their entirety within the outer concave recess 72 while the longitudinal slot 70 is still open to the full extent, to be precise the end side 69 of the hollow profile of the closure 68 being in alignment with the outer end surface 86 of the outer flange 56 on the base part 4. This ensures that, even in the pre-assembled, open position of the air-extraction valve 62, there are no elements thereof projecting from the base surface of the adhesive dispenser. In this pre-assembled, open position of the air-extraction valve, the axially inner section of the outer circumferential surface 88 of the stub-like closure 68 is in retaining frictional engagement with the inner surface 84 of the sleeve 66, said inner surface serving as push-in guide.

I claim:

1. An adhesive dispenser for cyanoacrylate, comprising a receiving container (2) having an open end which is sealed by a pushed-in base part (4) which projects into the receiving container, by means of a plunger-like body, with said base part comprising an opening (64) which is sealed by a closure (68) element, wherein interacting engagement surfaces of the receiving container (2) and base part (4), are of oval cross-sectional shape wherein the base part (4) is connected irreversibly to the receiving container (2) via a latching means (40, 42), which comprises a groove and tongue connection, with a latching tongue (40), which is adapted to encircle the plunger-like body of the base part (4), and to be interfitted into a complementary latching groove (42) in the inner wall (34) of the receiving container (2), wherein the encircling latching tongue (40) is subdivided into a plurality of circumferential segments **(40*a*)**.

2. The adhesive dispenser as claimed in claim 1, wherein the dispenser comprises retaining means device for providing clearance between the base part (4) and the receiving container (2) and wherein an outer flange (48) is formed on the receiving container (2) and, by means of an annular end-side protrusion (50), engages around the outer side of an outer flange (56) of the base part (4).

3. The adhesive dispenser as claimed in claim 2, wherein the annular end-side protrusion (50) of the outer flange (48) of the receiving container (2) engages in an encircling step (60) of the outer flange (56) of the base part (4).

* * * * *